US008997278B1

(12) United States Patent
Vanvliet

(10) Patent No.: US 8,997,278 B1
(45) Date of Patent: Apr. 7, 2015

(54) BEACH TOWEL ANCHOR SYSTEM

(71) Applicant: Rick Vanvliet, Jacksonville, FL (US)

(72) Inventor: Rick Vanvliet, Jacksonville, FL (US)

( * ) Notice: Subject to any disclaimer, the term of this patent is extended or adjusted under 35 U.S.C. 154(b) by 127 days.

(21) Appl. No.: 13/889,978

(22) Filed: May 8, 2013

(51) Int. Cl.
*F16M 13/00* (2006.01)
*E04H 15/62* (2006.01)
*A47G 9/06* (2006.01)

(52) U.S. Cl.
CPC ..... *E04H 15/62* (2013.01); *A47G 9/062* (2013.01)

(58) Field of Classification Search
USPC ..... 248/500, 505, 508, 545; 135/118; 52/155; 5/417, 658; D8/388, 391, D8/393–395; D21/796, 840; D26/67
See application file for complete search history.

(56) References Cited

U.S. PATENT DOCUMENTS

| | | | | |
|---|---|---|---|---|
| 2,647,718 | A | 8/1953 | Disera | |
| 2,840,092 | A * | 6/1958 | Hill | 135/118 |
| 2,939,468 | A * | 6/1960 | Boyce | 248/508 |
| 4,914,767 | A * | 4/1990 | Balicki et al. | 5/419 |
| D336,032 | S | 6/1993 | Brooks, Jr. | |
| 5,474,275 | A | 12/1995 | Robertson et al. | |
| 5,524,309 | A * | 6/1996 | La Barbera | 5/658 |
| 5,713,383 | A * | 2/1998 | Ramirez et al. | 135/118 |
| D476,556 | S * | 7/2003 | Martin et al. | D8/395 |
| 6,895,613 | B1 | 5/2005 | Clouston | |
| 7,159,256 | B1 * | 1/2007 | Licari | 5/417 |
| D697,395 | S * | 1/2014 | Adams | D8/395 |
| 2014/0036487 | A1 * | 2/2014 | Adams | 362/184 |

* cited by examiner

*Primary Examiner* — Alfred J Wujciak

(57) ABSTRACT

The present invention features a beach towel anchor system for securing a beach towel on a ground surface. The system features a rectangular beach towel and a plurality of towel anchors. The towel anchor features a pivoting clamp having a top clamping interface and a bottom clamping interface. The towel anchor features a first pivoting lever and a flexible pullstrap located on a clamp top lever. The towel anchor features a second pivoting lever located on a clamp bottom lever. The towel anchor features a removable ground projection centrally located on the clamp bottom lever. The removable ground projection is inserted into the ground surface. The pivoting clamp is pivoted into a first open position. The beach towel is inserted into the pivoting clamp. The pivoting clamp is released and clamped on the beach towel in a second closed position via a spring bias.

3 Claims, 3 Drawing Sheets

BEACH TOWEL ANCHOR SYSTEM

FIELD OF THE INVENTION

The present invention relates to clamp systems, or more specifically, anchorable clamping systems for beach towels.

BACKGROUND OF THE INVENTION

Beach towels have been used for many years to provide comfort and protection for a user when lying down on a ground surface. One drawback, in using a beach towel in this manner, however, is that the towel can be blown out of position by the wind, picking up dirt or debris along the way. The present invention features a beach towel anchor system for securing a beach towel on a ground surface Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a beach towel anchor system for securing a beach towel on a ground surface. In some embodiments, the system comprises a rectangular beach towel. In some embodiments, the system comprises a plurality of towel anchors.

In some embodiments, the towel anchor comprises a pivoting clamp. In some embodiments, the clamp comprises a top clamping interface located on a terminating clamp anterior end of a clamp top lever comprising a shape of a half cylinder from a clamp first side to a clamp second side. In some embodiments, the clamp comprises a bottom clamping interface located on the terminating clamp anterior end of a clamp bottom lever comprising the shape of the half cylinder from the clamp first side to the clamp second side.

In some embodiments, the towel anchor comprises a first pivoting lever located on a clamp posterior end of the clamp top lever. In some embodiments, the towel anchor comprises a flexible pullstrap centrally located on the clamp top lever. In some embodiments, the towel anchor comprises a second pivoting lever located on the clamp posterior end of the clamp bottom lever. In some embodiments, the towel anchor comprises a removable ground projection centrally located on the clamp bottom lever.

In some embodiments, the removable ground projection is inserted into the ground surface. In some embodiments, the pivoting clamp is pivoted into a first open position via either the first pivoting lever or the flexible pullstrap. In some embodiments, either a towel first side or a towel second side is inserted into the pivoting clamp. In some embodiments, the pivoting clamp is released and clamped on the beach towel in a second closed position.

DESCRIPTION OF PREFERRED EMBODIMENTS

Figure 1:
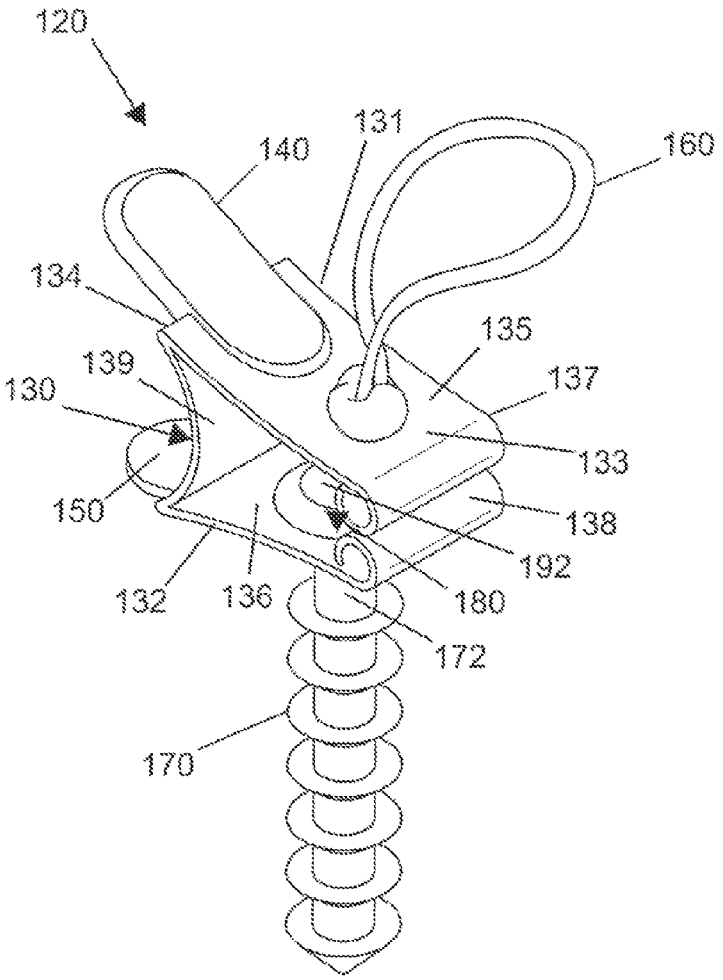
FIG. 1 shows a perspective view of the towel anchor of the present invention.
Figure 2:
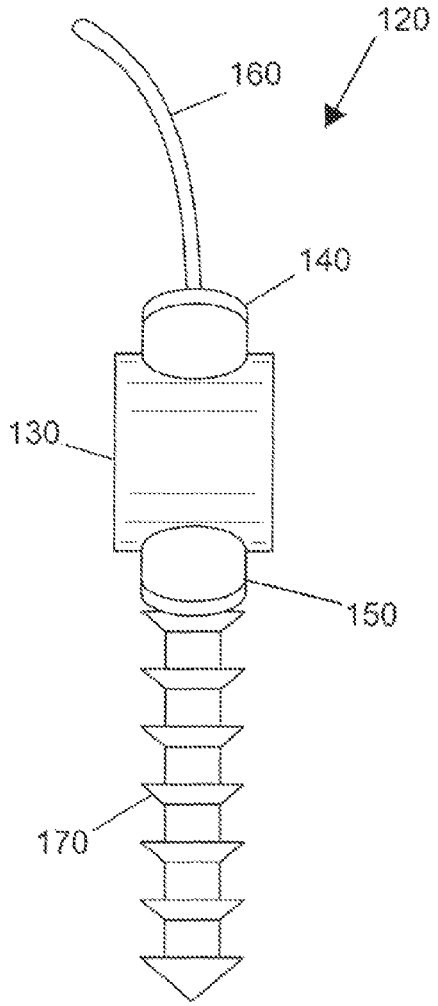
FIG. 2 shows a back view of the towel anchor of the present invention.
Figure 3:
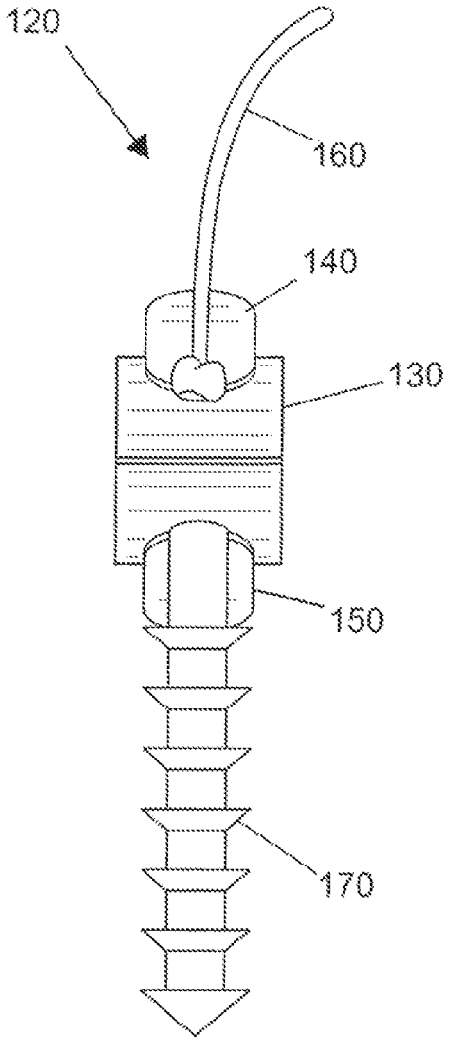
FIG. 3 shows a front view of the towel anchor of the present invention.
Figure 4:
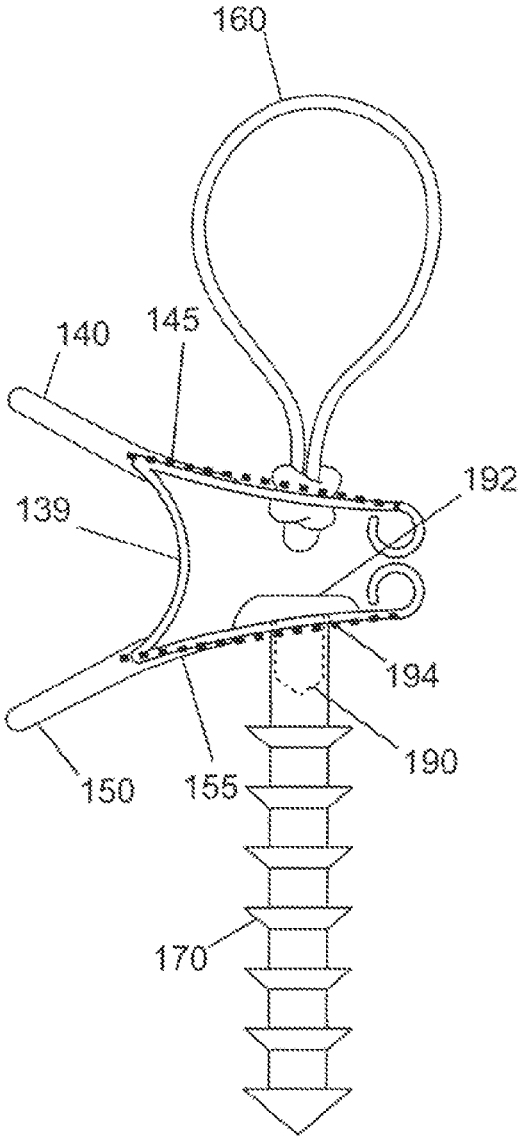
FIG. 4 shows a side view of the towel anchor of the present invention.
Figure 5:
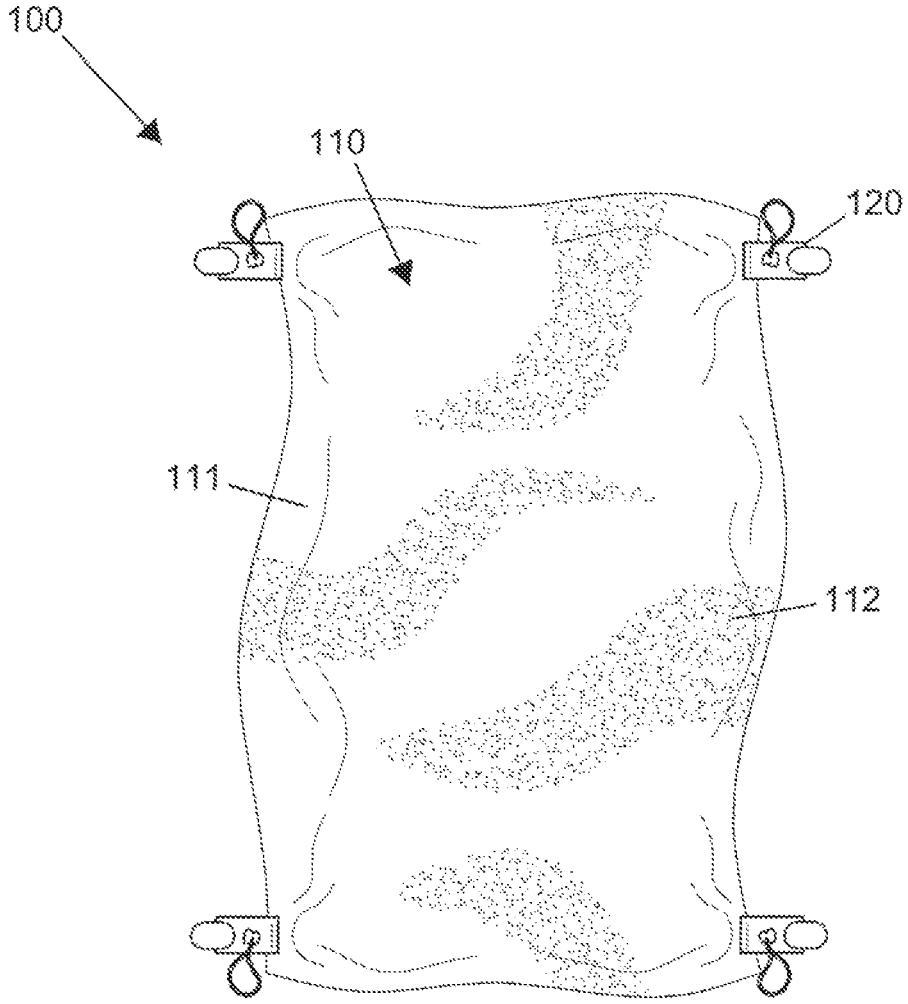
FIG. 5 shows an overhead view of the present invention.

Following is a list of elements corresponding to a particular element referred to herein:

100 Beach towel anchor system
110 Beach towel
111 Towel first side
112 Towel second side
120 Towel anchor
130 Pivoting clamp
131 Clamp first side
132 Clamp second side
133 Clamp anterior end
134 Clamp posterior end
135 Clamp top lever
136 Clamp bottom lever
137 Top clamping interface
138 Bottom clamping interface
139 Clamp posterior end component
140 First pivoting lever
145 Clamp top lever plane
150 Second pivoting lever
155 Clamp bottom lever plane
160 Flexible pullstrap
170 Ground projection
172 Ground projection anterior end
180 Attaching means
190 Ground projection aperture
192 Push clip
194 Clamp bottom lever aperture Referring now to FIG. 1-5, the present invention features a beach towel anchor system (100) for securing a beach towel on a ground surface. In some embodiments, the system (100) comprises a rectangular beach towel (110) having a towel first side (111) and a towel second side (112).

In some embodiments, the system (100) features a plurality of towel anchors (120). In some embodiment, the towel anchor (120) comprises a pivoting clamp (130) having a clamp first side (131), a clamp second side (132), a clamp anterior end (133), a clamp posterior end (134), an arc shaped clamp top lever (135), and an are shaped clamp bottom lever (136). In some embodiments, the pivoting clamp (130) comprises a general shape of a "U" in a coronal plane. In some embodiments, the pivoting clamp (130) comprises a top clamping interface (137) located on a terminating clamp anterior end (133) of the clamp top lever (135). In some embodiments, the top clamping interface (137) comprises a shape of a half cylinder from the clamp first side (131) to the clamp second side (132). In some embodiments, the pivoting clamp (130) comprises a bottom clamping interface (138) located on a terminating clamp anterior end (133) of the clamp bottom lever (136). In some embodiments, the bottom clamping interface (138) comprises a shape of a half cylinder from the clamp first side (131) to the clamp second side (132) In some embodiments, the clamp top lever (135) is connected to the clamp bottom lever (136) via an arc shaped spring bias clamp posterior end component (139).

In some embodiments, the top clamping interface (137) and the bottom clamping interface (138) each interface on a cylindrically shaped side wall.

In some embodiment, the towel anchor (120) comprises a first pivoting lever (140) located on the clamp posterior end (134) of the clamp top lever (135). In some embodiments, the first pivoting lever (140) projects out and away from the clamp posterior end (134). In some embodiments, the first pivoting lever (140) and the clamp top lever (135) are located on a clamp top lever plane (145). In some embodiments, the first pivoting lever (140) and the clamp top lever (135) are generally located on a clamp top lever plane (145). In some embodiments, the first pivoting lever (140) and the clamp top lever (135) each have a point located on a clamp top lever plane (145). In some embodiments, the first pivoting lever (140) is arc shaped.

In some embodiment, the towel anchor (120) comprises a flexible pullstrap (160) centrally located on the clamp top lever (135). In some embodiments, the flexible pullstrap (160) projects out and away from the clamp top lever (135). In some embodiments, the flexible pullstrap (160) is located midway between the clamp anterior end (133) and the clamp posterior end (134). In some embodiments, the flexible pullstrap (160) is perpendicularly located with respect to the clamp top lever (135). In some embodiments, it is critical to have both the first pivoting lever (140) and the flexible pullstrap (160) for pivoting. In some embodiments, the flexible pullstrap (160) is for pulling the towel anchor (120) from the ground.

In some embodiment, the towel anchor (120) comprises a second pivoting lever (150) located on the clamp posterior end (134) of the clamp bottom lever (136). In some embodiments, the second pivoting lever (150) projects out and away from the clamp posterior end (134). In some embodiments, the second pivoting lever (150) and the clamp bottom lever (136) are located on a clamp bottom lever plane (155). In some embodiments, the second pivoting lever (150) and the clamp bottom lever (136) are generally located on a clamp bottom lever plane (155). In some embodiments, the second pivoting lever (150) and the clamp bottom lever (136) each have a point located on a clamp bottom lever plane (155). In some embodiments, the second pivoting lever (150) is arc shaped.

In some embodiments, the towel anchor (120) comprises a removable ground projection (170) centrally located on the clamp bottom lever (136). In some embodiments, the ground projection (170) projects out and away from the clamp bottom lever (136). In some embodiments, the ground projection (170) is located midway between the clamp anterior end (133) and the clamp posterior end (134). In some embodiments, the ground projection (170) is perpendicularly located with respect to the clamp bottom lever (136). In some embodiments, the ground projection (170) comprises an attaching means (180). In some embodiments, the ground projection anterior end (172) is attachably located on the clamp bottom lever (136) via the attaching means (180).

In some embodiments, the removable ground projection (170) comprises an inclined planed wrapped around itself to form screw threads. In some embodiments, the removable ground projection (170) comprises barbs disposed thereon.

In some embodiments, the removable ground projection (170) is inserted into the ground surface. In some embodiments, the pivoting clamp (130) is pivoted into a first open position via either the first pivoting lever (140) or the flexible pullstrap (160). In some embodiments, either a towel first side (111) or a towel second side (112) is inserted into the pivoting clamp (130). In some embodiments, the pivoting clamp (130) is released and clamped on the beach towel (110) in a second closed position. In some embodiments, the beach towel (110) is secured via the top clamping interface (137) acting towards the bottom clamping interface (138) via the spring biased clamp posterior end component (139).

In some embodiments, the attaching means (180) comprises a ground projection aperture (190) located on the ground projection anterior end (172) and a mated push clip (192) located through a clamp bottom lever aperture (194).

In some embodiments, the system (100) comprises four towel anchors (120).

As used herein, the term "about" refers to plus or minus 10% of the referenced number.

The disclosures of the following U.S. Patents are incorporated in their entirety by reference herein: U.S. Pat. No. D 336,032; U.S. Pat. No. 7,159,256; U.S. Pat. No. 6,895,613; U.S. Pat. No. 5,524,309; U.S. Pat. No. 5,474,275; and U.S. Pat. No. 2,647,718.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures.

The reference numbers recited in the below claims are solely for ease of examination of this patent application, and are exemplary, and are not intended in any way to limit the scope of the claims to the particular features having the corresponding reference numbers in the drawings.

What is claimed is:

1. A beach towel anchor system (100) for securing a beach towel on a ground surface, wherein the system (100) comprises:

(a) a rectangular beach towel (110) having a towel first side (111) and a towel second side (112); and (b) a plurality of towel anchors (120), wherein the towel anchor (120) comprises:

(i) a pivoting clamp (130) having a clamp first side (131), a clamp second side (132), a clamp anterior end (133), a clamp posterior end (134), an arc shaped clamp top lever (135), and an arc shaped clamp bottom lever (136), wherein the pivoting clamp (130) comprises a shape of a "U" in a coronal plane, wherein the pivoting clamp (130) comprises a top clamping interface (137) disposed on the terminating clamp anterior end (133) of the clamp top lever (135), wherein the top clamping interface (137) comprises a shape of a half cylinder from the clamp first side (131) to the clamp second side (132), wherein the pivoting clamp (130) comprises a bottom clamping interface (138) disposed on the terminating clamp anterior end (133) of the clamp bottom lever (136), wherein the bottom clamping interface (138) comprises the shape of the half cylinder from the clamp first side (131) to the clamp second side (132), wherein the clamp top lever (135) is disposed on the clamp bottom lever (136) via an arc shaped spring bias clamp posterior end component (139), (ii) a first pivoting lever (140) disposed on the clamp posterior end (134) of the clamp top lever (135), wherein the first pivoting lever (140) projects out and away from the clamp posterior end (134), wherein the first pivoting lever (140) and the clamp top lever (135) are disposed on a clamp top lever plane (145), (iii) a flexible pullstrap (160) centrally disposed on the clamp top lever (135), wherein the flexible pullstrap (160) projects out and away from the clamp top lever (135), wherein the flexible pullstrap (160) is disposed midway between the clamp anterior end (133) and the clamp posterior end (134), wherein the flexible pullstrap (160) is perpendicularly disposed with respect to the clamp top lever (135), (iv) a second pivoting lever (150) disposed on the clamp posterior end (134) of the clamp bottom lever (136), wherein the second pivoting lever (150) projects out and away from the clamp posterior end (134), wherein the second pivoting lever (150) and the clamp bottom lever (136) are disposed on a clamp bottom lever plane (155), and (v) a removable ground projection (170) centrally disposed on the clamp bottom lever (136), wherein the ground projection (170) projects out and away from the clamp bottom lever (136), wherein the ground projection (170) is disposed midway between the clamp anterior end (133) and the clamp posterior end (134), wherein the ground projection (170) is perpendicularly disposed with respect to the clamp bottom lever (136), wherein the ground projection (170) comprises an attaching means (180), wherein a ground projection anterior end (172) is attachably disposed on the clamp bottom lever (136) via the attaching means (180);

wherein the removable ground projection (170) is inserted into the ground surface, wherein the pivoting clamp (130) is pivoted into a first open position via either the first pivoting lever (140) or the flexible pullstrap (160), wherein either the towel first side (111) or the towel second side (112) is inserted into the pivoting clamp (130), wherein the pivoting clamp (130) is released and clamped on the beach towel (110) in a second closed position, wherein the beach towel (110) is secured via the top clamping interface (137) acting towards the bottom clamping interface (138) via the spring biased clamp posterior end component (139).

2. The system (100) of claim 1, wherein the attaching means (180) comprises a ground projection aperture (190) disposed on the ground projection anterior end (172) and a mated push clip (192) disposed through a clamp bottom lever aperture (194).

3. The system (100) of claim 1, wherein the system (100) comprises four towel anchors (120).

* * * * *